US009228793B2

(12) United States Patent
Samaras et al.

(10) Patent No.: US 9,228,793 B2
(45) Date of Patent: Jan. 5, 2016

(54) ALL-IN-ONE MUZZLE LOADING DEVICE

(76) Inventors: Gregory Samaras, Bayside, NY (US); Edward J. Boll, Stuyvesant, NY (US)

( * ) Notice: Subject to any disclaimer, the term of this patent is extended or adjusted under 35 U.S.C. 154(b) by 201 days.

(21) Appl. No.: 12/815,505

(22) Filed: Jun. 15, 2010

(65) Prior Publication Data

US 2011/0302818 A1 Dec. 15, 2011

(51) Int. Cl.
*F41A 9/61* (2006.01)
*F41C 9/08* (2006.01)

(52) U.S. Cl.
CPC ..... *F41C 9/085* (2013.01)

(58) Field of Classification Search
USPC ..... 42/51, 90, 91; 89/1.3
See application file for complete search history.

(56) References Cited

U.S. PATENT DOCUMENTS 4,010,565 A * 3/1977 DiProspero ..... 42/106
4,050,175 A * 9/1977 Mulinix ..... 42/90
4,094,098 A * 6/1978 Gourley ..... 42/90
4,112,606 A * 9/1978 Griffin ..... 42/90
4,135,322 A * 1/1979 Tice et al. ..... 42/90
4,152,858 A * 5/1979 Dobbs ..... 42/90
4,207,698 A * 6/1980 Burson ..... 42/90
4,411,088 A * 10/1983 Wilson ..... 42/90
4,442,620 A * 4/1984 Drake et al. ..... 42/90
4,466,209 A * 8/1984 Strickland et al. ..... 42/90
4,533,019 A * 8/1985 Leding ..... 184/14
4,550,517 A * 11/1985 Mansfield ..... 42/90
4,589,220 A * 5/1986 Lofland ..... 42/90
4,601,125 A * 7/1986 Curtis ..... 42/90
4,607,446 A * 8/1986 Scheuring ..... 42/90
4,785,566 A * 11/1988 Story ..... 42/90
4,802,297 A * 2/1989 French ..... 42/90
4,974,357 A * 12/1990 Jones et al. ..... 42/90
5,092,072 A * 3/1992 Fritts ..... 42/90
5,097,615 A * 3/1992 Kearns ..... 42/90
5,109,623 A 5/1992 French
5,127,179 A * 7/1992 Marsh ..... 42/90
5,169,999 A * 12/1992 Jenkins ..... 42/90
5,419,071 A * 5/1995 Fatica ..... 42/90
6,637,143 B1 * 10/2003 Wykle ..... 42/90
7,165,351 B2 * 1/2007 Church ..... 42/51
7,451,563 B1 * 11/2008 McKnight ..... 42/51
8,112,932 B1 * 2/2012 Vollmer ..... 42/90
2006/0162218 A1 * 7/2006 Church ..... 42/51

* cited by examiner

*Primary Examiner* — Samir Abdosh
(74) *Attorney, Agent, or Firm* — Schmeiser, Olsen & Watts, LLP

(57) ABSTRACT

An all in one muzzle loading device is a T-shaped device used to store and quickly reload a gun during a successive shot. The all in one muzzle loading device has a handle and a stem forming the T-shaped configuration. The stem releasably holds the projectile and the handle holds gunpowder pellets, and primer. A cap is disposed at an end of the handle to hold the pellets within the handle. The primer is manipulated on the handle using a slideable primer applicator that, in an extended position, disposes the primer a distance from the handle. The handle also has lip extending from its side being a ram rod receiver. The ram rod receiver is designed to hold a ram rod without restraint thus permitting the ram rod to rotate or twist freely.

18 Claims, 4 Drawing Sheets

ALL-IN-ONE MUZZLE LOADING DEVICE

FIELD OF THE INVENTION

The present invention relates to a muzzle loading device. Specifically, the present invention relates to a muzzle loading device for storing projectiles, powders and primers and combining all tools required as well as facilitating use of ram rods when loading firing elements into a muzzle loader rifle or pistol.

BACKGROUND OF THE INVENTION

Hunters continue to hunt with muzzle-load firearms, such as rifles and pistols, due to the historical significance, and due to today's modern muzzle-loaders long-range accuracy and because hunting seasons are at times restricted to muzzle loaders. In order to muzzle-load a rifle or pistol, compressed powder pellets or (loose powder) and a projectile, such as a bullet, must be loaded in the muzzle of the rifle, and a percussion cap or primer must be placed on the nipple or firing mechanism of the rifle. Thus, requiring a person utilizing a muzzle-loading rifle to carry with him quantities of compressed powder or loose pellets, bullets and percussion caps or primer. While it is desirable to expedite the loading of such rifles, the procedures required to load the rifle cannot be automated. A problem associated with use of muzzle loading rifles in game hunting is the time required to load or reload under actual field conditions of use. A period typically of one or two minutes is required to assemble all the necessary items carried by the hunter and all components to be individually inserted in the muzzle for proper charging. Traditionally, all loading tools, charges, primers and bullets are carried in the field in a "Possibles" bag.

Accordingly, a device is desired that eliminates the "Possibles" bag and/or any pouch used to carry the above-listed items. Also, a device is desired that stores muzzle charge and facilitates the loading of the charge into a muzzle loading firearm so that the firearm can fire a shot or second/follow up shot quickly. A device is also desired that may be easily carried by the hunters without interfering with normal activities. It is also desired that the device be economical to manufacture and sell within the price range acceptable to a large number of muzzle loading firearm owners. In as much as the art is relatively crowded with respect to these various types of speed loading devices, it can be appreciated that there is a continuing need for and interest in improvements to such speed loading devices, and in this respect, the present invention addresses this need and interest.

BRIEF SUMMARY OF THE INVENTION

An all in one muzzle loading device of the present invention is a T-shaped device used to store ingredients needed for a second shot and to quickly reload a gun during a successive shot. The all in one muzzle loading device has a handle and a stem forming the T-shaped configuration. The stem releasably holds the projectile and the handle holds gunpowder pellets, and primer. A cap is disposed at an end of the handle to hold the pellets within the handle. The primer is manipulated on the handle using a slideable primer applicator that, in an extended position, disposes the primer a distance from the handle. The handle also has a lip extending from its side being a ram rod receiver. The ram rod receiver is designed to position a ram rod without restraint thus permitting the ram rod to rotate or twist freely.

DETAILED DESCRIPTION OF THE INVENTION

Figure 1:
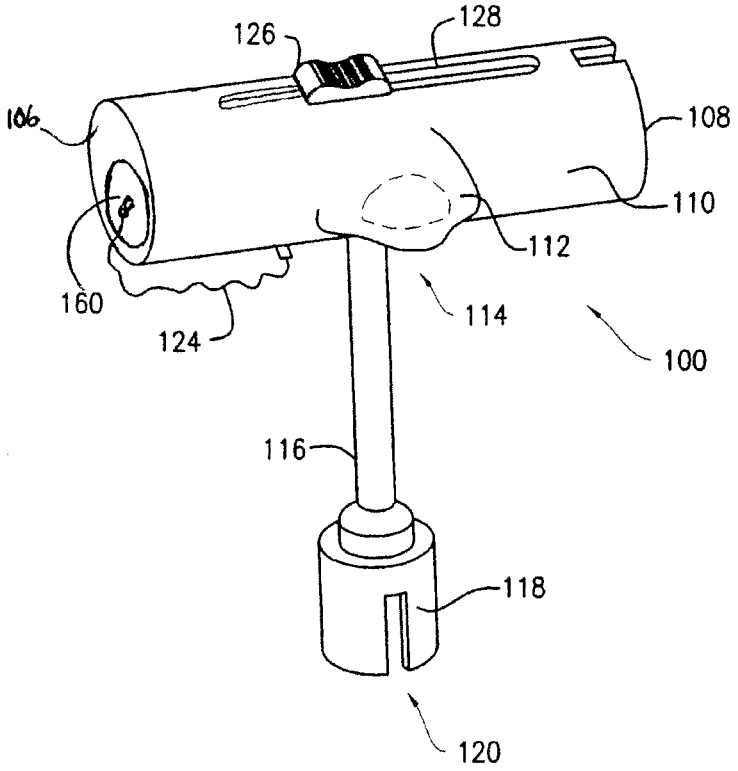
FIG. 1 is a front and left side perspective view of the all in one muzzle loading device with a primer applicator in a retracted position.
Figure 2:
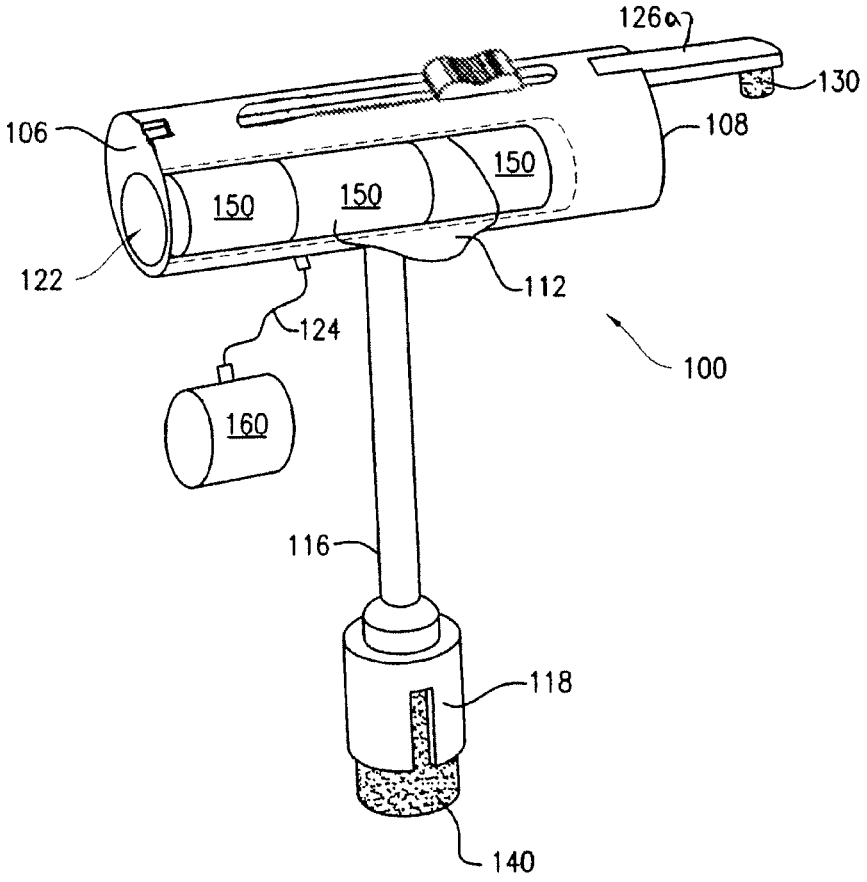
FIG. 2 is a view of the all in one muzzle loading device of FIG. 1 with a primer applicator/extractor in an extended in an application position and a cap removed from a first end of the handle and a projectile held by the muzzle loader.
Figure 3:
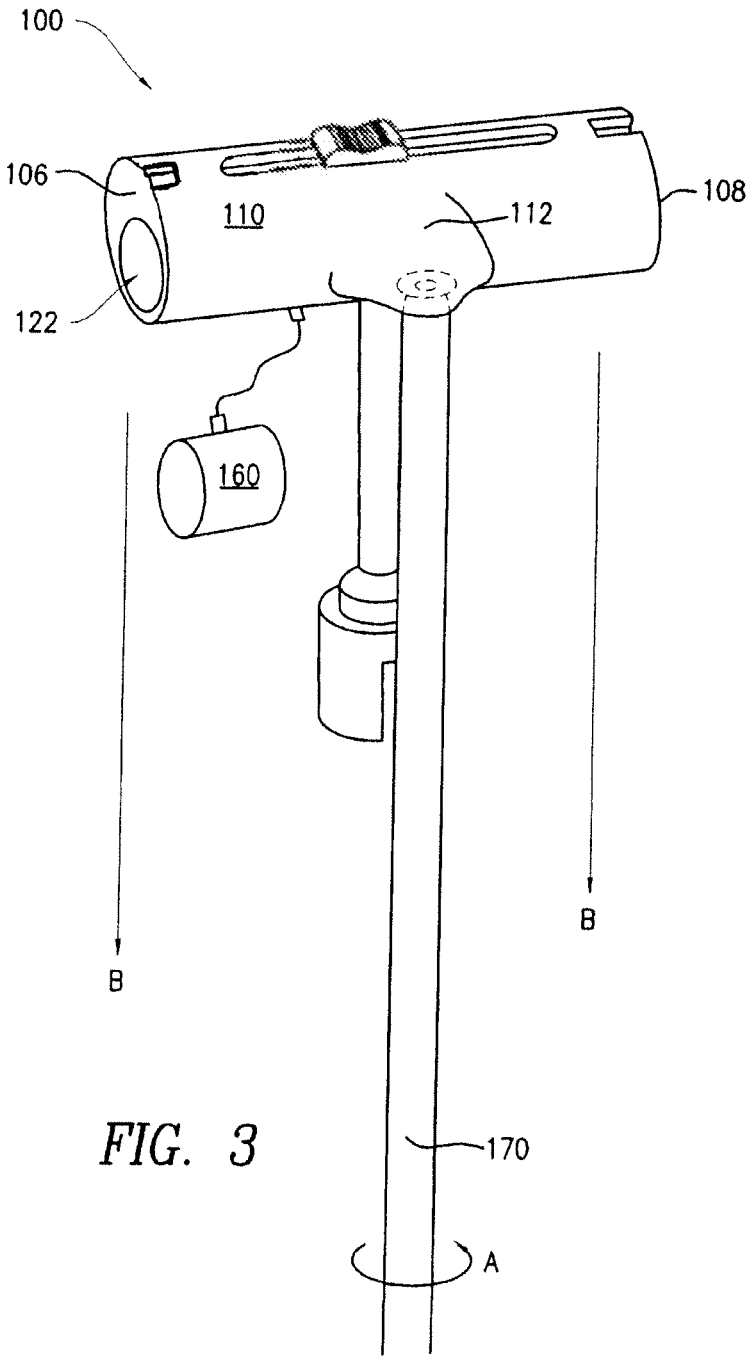
FIG. 3 is a view of the all in one muzzle loading device of FIG. 1 with a ram rod positioned in a ram rod holder (palm-saver).

Referring to FIGS. 1 and 2, an all in one muzzle loading device 100 for muzzle loading a firearm of the present invention is a T-shaped device defined by a tubular hollow handle 110 and a stem 116. The handle 110 has a first end 106, a second end 108, a central region defined between said first and second ends 106, 108, a ram rod holder/receiver 112 disposed in said central region of the handle 110, a slidable primer applicator 126 having an applicator end **126*a* and an extractor end 126*b* and a cap 160 disposed at the first end 106. The stem 116 has a first end and a second end. The first end of the stem 116 perpendicularly bisected the handle 110 to form the T-shaped configuration. The opposite or second end of the stem 116 has a projectile holder 118 with an opening 120 being dimensioned and configured to releasably hold a projectile 140**.

Referring to FIG. 2, the cap 160 is removably attached in the first end 106 of the handle 110 by a connection means 124. The cap 160 can be quickly and easily removed to expose a storage compartment 122 that is dimensioned and configured to receive material such as gunpowder or gun powder pellets 150. In a preferred embodiment, the compartment 122 stores up to three pellets 150 for reload purposes. In embodiment shown in the figures, the cap 160 is disposed in the storage compartment 122, however the cap need not be limited in design and may be disposed on the first end 106 of the handle or otherwise connected to the first end 106.

Figure 4:
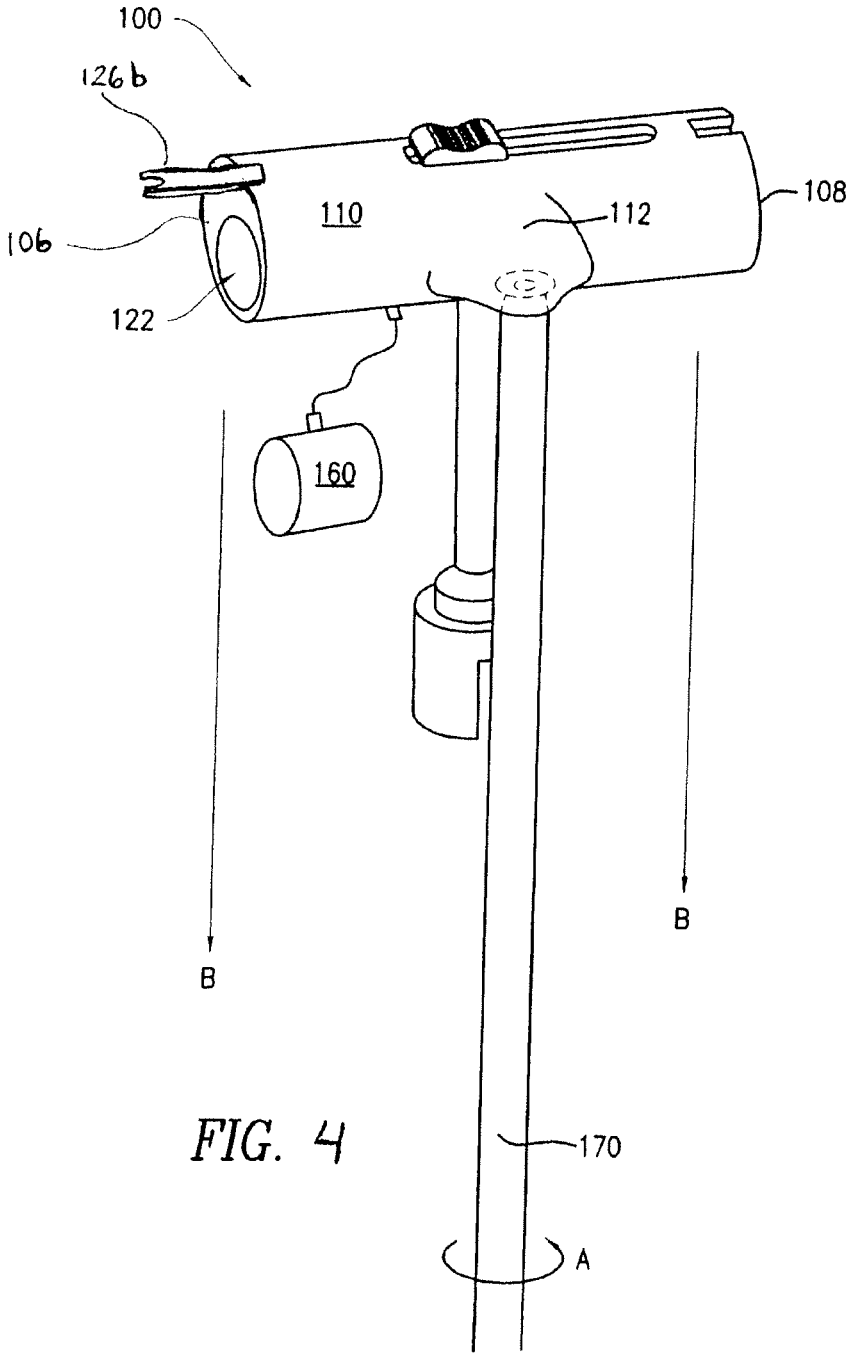
FIG. 4 is a view of the all in one muzzle loading device of FIG. 1 with a primer applicator/extractor in an extended in an extractor position which is opposite from that shown in FIG. 2.

The handle 110 has a groove 128 to allow the slideable primer applicator 126 to glide between a retracted position (FIG. 1) and extended positions (FIGS. 2 and 4). In the extended-application position, the applicator 126 extends past the second end 108 of the handle and exposes a primer 130 that is stored on the application end **126*a* of the applicator 126 and that can be releasably disposed from the end of the applicator 126. In some embodiment, the second end 108 of the handle 110 may be threaded (not shown) to receive various accessories. FIG. 4 shows the extractor 126*b* of the applicator 126 being extended past the first end 106 of the handle. The extractor end 126*b* of the applicator 126 is forked so it can extract primer once the gun has been shot. If, however, the primer is positioned for use in the gun, but later the user decides not to fire the gun, then the unused primer must be removed by using the extractor 126*b*** to carefully take out the unused primer from the gun.

Referring still to FIG. 2, the ram rod holder/receiver 112 is a lip extending from and disposed on the central region of the handle 110. The ram rod receiver 112 has a depression 114 that is dimensioned and configured to freely hold an end of a ram rod 170 allowing the ram rod 170 to rotate or twist in the depression 114. Thus, with the ram rod 170 placed in the ram rod holder 112, pressure placed on the said handle 110 will be evenly distributed on said ram rod 170.

Pre-Loading the Muzzle Loader

A user may pre-load the all in one muzzle loading device 100 with the primer 130, the pellets 150 and the projectile 140. Specifically, the user can, in any order, fix a primer 130 at the applicator end 126*a* of the applicator 126 and retract the applicator 126 into the handle to store the primer 130 within the handle 110. Up to three pellets 150 may be placed in the storage compartment 122 of the handle 110 and be secured with the cap 160 that is dimensioned and configured to the first end to hold the pellets 150 in the compartment 122. Finally, a projectile 140 may be fitted in the opening 120 to be releasable from the projectile holder 118.

Loading the Barrel with the all in One Muzzle Loading Device

When the user is ready to load or reload a gun barrel, the user holds the all in one muzzle loading device 100 by the handle 110 removes the cap 160 and aligns the first end 106 with the opening of a barrel so the pellets 150 may drop into the barrel. Once the pellets 150 are in place, the user turns the all in one muzzle loading device 100 ninety degrees to align the projectile holder 118 with the opening of the barrel and pushes the projectile 140 into the gun barrel.

With the all in one muzzle loading device 100 in the same position, but out of the barrel, the user takes a ram rod 170 and places an end of the ram rod into the barrel of the rifle or pistol. Afterwards positions the depression 114 at the tip of the ramrod which is dimensioned and configured to receive the ram rod 170, yet freely position the ram rod 170 allowing the rod 170 to rotate or yield (see arrow A) to twists within the barrel as the user pushes down on the handle 110 (see arrows B). With the depression 114 able to freely grasp the ram rod 170, the user is can to bush the material within the barrel without deforming or causing harm to the projectile 140. The ram rod holder 112 is positioned at the center region of the handle 110 on one side of the handle 100 and allows the user to evenly apply pressure on the rod 170 as it is pushed into the barrel. The handle 110 of the all in one muzzle loading device 100 is ergonomic in that it permits easy bushing without inflicting pain to the user's hand.

With the pellets 150 and projectile 140 in place, the user can slide the applicator 126 along the groove 128 to expose the primer 130 and place the primer 130 a distance from the second end 108 of the handle 110 for easy application. Specifically, by extending the applicator 126 away from the second end 108, the user can quickly expose the primer on the applicator end 126*a* and position the primer 130 on the firing mechanism of the rifle readying the pellet 130 to be struck by the hammer. Thus, the user is able to reload pellets 150, position the projectile, bush the material in the barrel and place the primer 130 on the firing mechanism all using the all in one muzzle loading device 100 device of the present invention.

While the invention has been described by way of example and in terms of specific embodiments it is not so limited and is intended to cover various modifications as would be apparent to those skilled in this art area. Therefore, the scope of the appended claims should be accorded the broadest interpretation so as to encompass all such modifications.

What is claimed:

1. A device for muzzle loading a firearm comprising:

a handle, said handle having a storage compartment being dimensioned and configured to receive gunpowder pellets; and a primer applicator, said primer applicator being slideably mounted on the handle having a retracted position and an extended position, said primer applicator in said retracted position retaining primer within the handle, said primer applicator in said extended position disposing the primer a distance from the handle while the primer is still attached to the primer applicator.

2. The device of claim 1, wherein said handle is a hollow tube having a first end and a second end, said tube serving as said storage compartment for gunpowder pellets, said storage compartment having an opening at said first end, said opening and said storage compartment being dimensioned and configured to receive gunpowder pellets.

3. The device of claim 1, further comprising a stem having a first end and a second end, said first end being connected to the handle, said second end having a projectile holder, said projectile holder being dimensioned and configured to releasably hold a projectile.

4. The device of claim 3, wherein said stem is perpendicularly connected to the handle forming a T-shaped configuration.

5. The device of claim 1, further comprising a ram rod receiver disposed on a central region on said handle, said ram rod receiver being dimensioned and configured to freely position at the end of a ram rod allowing the ram rod to rotate or twist, wherein pressure placed on the said handle evenly distributes pressure on said ram rod held by the ram rod receiver.

6. The device of claim 5, wherein said ram rod receiver is a lip extending from a side and the central region of said handle.

7. A device for muzzle loading comprising:

a handle, said handle having a storage compartment being dimensioned and configured to receive gunpowder pellets; and a ram rod receiver disposed on a side and a central region on said handle, said ram rod receiver being dimensioned and configured to freely hold an end of a received ram rod allowing the received ram rod to rotate or twist, wherein pressure placed on the said handle evenly distributes pressure on said received ram rod held by the ram rod receiver, wherein the received ram rod is removably held by the ram rod receiver.

8. The device of claim 7, wherein said ram rod receiver is a lip extending from a side and the central region of said handle.

9. The device of claim 7, wherein said handle is a hollow tube having a first end and a second end, wherein said central region is disposed between said first end and said second end, said tube serving as said storage compartment for gunpowder pellets, said storage compartment having an opening at said first end, said opening and said storage compartment being dimensioned and configured to receive pellets.

10. The device of claim 9, further comprising a cap dimensioned and configured to releaseably close said opening at said first end.

11. The device of claim 7, further comprising a primer applicator, said primer applicator being slideably mounted on the handle having a retracted position and an extended position, said primer applicator in said retracted position retaining primer within the handle, said primer applicator in said extended position disposing the primer a distance from the handle.

12. The device of claim 7, further comprising a stem having a first stem end and a second stem end, said first stem end being connected to the handle, said second stem end having a projectile holder, said projectile holder being dimensioned and configured to releasably hold a projectile.

13. The device of claim 12, wherein said stem is perpendicularly connected to the handle forming a T-shaped configuration.

14. A device for muzzle loading comprising:

a tubular hollow handle, having a first end, a central region and a second end wherein said central region is disposed between said first end and said second end, said handle having a storage compartment disposed therein, said storage compartment having an opening at said first end, said opening and said storage compartment being dimensioned and configured to receive pellets;

a stem having a first stem end and a second stem end, said first stem end being connected to the handle, said second stem end having a projectile holder, said projectile holder being dimensioned and configured to releasably hold a projectile;

a slideable primer applicator mounted on said handle, said slideable primer applicator having a primer retaining end, said slideable primer applicator being slideable between a refracted position and an extended position, said primer applicator in said extended position disposing the primer a distance from the handle while the primer is still attached to the primer applicator; and a ram rod receiver, said ram rod receiver disposed on a side and at a central region on said handle, said ram rod receiver being dimensioned and configured to freely hold an end of a received ram rod allowing the received ram rod to rotate or twist, wherein the received ram rod is removably held by the ram rod receiver.

15. The device of claim 14, wherein said stem is perpendicularly connected to the handle forming a T-shaped configuration.

16. The device of claim 14, wherein said primer applicator in said refracted position retaining primer on said primer retaining end within the handle.

17. The device of claim 14, wherein said primer applicator in said extended position disposing the primer on said primer retaining end at a distance from the second end of the handle.

18. The device of claim 14, wherein said ram rod receiver is a lip extending from a side and the central region of said handle, wherein pressure placed on the said handle evenly distributes pressure on said received ram rod held by the ram rod receiver.

* * * * *